United States Patent [19]

Seynhaeve

[11] Patent Number: 5,014,830

[45] Date of Patent: May 14, 1991

[54] FASTENING DEVICES FOR STRAPS IN AN ARTICLE OF LUGGAGE

[75] Inventor: Andre Seynhaeve, Senlis, France

[73] Assignee: Delsey, S.A., France

[21] Appl. No.: 467,557

[22] Filed: Jan. 19, 1990

[30] Foreign Application Priority Data

Jan. 20, 1989 [FR] France ..... 89 00642

[51] Int. Cl.[5] ..... A45C 13/30

[52] U.S. Cl. ..... 190/36; 190/13 C; 206/293; 217/64

[58] Field of Search ..... 190/36, 109, 119, 103, 190/13 C; 206/292, 293; 217/64, 86

[56] References Cited

U.S. PATENT DOCUMENTS

| | | | |
|---|---|---|---|
| 450,533 | 4/1891 | Schmadel | 190/36 |
| 749,959 | 1/1904 | Curtiss | 190/36 |
| 792,246 | 6/1905 | Andrews et al. | 190/36 |
| 1,056,648 | 3/1913 | Earley | 190/36 |
| 1,496,498 | 6/1924 | Tantlinger | 190/36 |
| 1,704,114 | 3/1929 | Wisby | 190/36 |
| 1,844,335 | 2/1932 | Ritter, Jr. | 206/292 |
| 2,028,339 | 1/1936 | Levine et al. | 206/292 |
| 4,727,987 | 3/1988 | Zezza | 190/36 X |

FOREIGN PATENT DOCUMENTS

| | | | |
|---|---|---|---|
| 250603 | 9/1912 | Fed. Rep. of Germany | 206/293 |
| 725572 | 2/1932 | France | 190/36 |
| 583992 | 1/1947 | United Kingdom | 190/119 |

*Primary Examiner*—Sue A. Weaver

*Attorney, Agent, or Firm*—Finnegan, Henderson, Farabow, Garrett & Dunner

[57] ABSTRACT

An article of luggage of the type comprising elastic straps for holding down the objects carried therein, characterized in that each end of a strap (14) is fixed to the inner wall of the suitcase by means of a fastening member (15) carrying an anchoring clamp (17) for one end of said strap and at least one hook (16, 18) having a gap (19) on one of its sides, through which the strap may be inserted into either of said hooks (16, 18) for modifying the spacing of said strap from the bottom of the suitcase.

9 Claims, 2 Drawing Sheets

FASTENING DEVICES FOR STRAPS IN AN ARTICLE OF LUGGAGE

This invention relates to articles of luggage and more specifically to straps provided in such articles for keeping pieces of clothing contained therein in proper arrangement while the luggage is being carried. Such straps are usually attached by sewing or by gluing in various points along the peripheral wall, generally in the vicinity of the bottom of the article of luggage.

A problem which will then arise is that, after the article of luggage has been filled, the straps, when fastened, will press on the clothing articles, and will cram them down so as to form a pile having the shape of a truncated pyramid.

It has already been attempted to attach these straps to the article of luggage at a certain distance from the bottom, but this will not properly solve the problem which is to avoid pushing down the articles of clothing when a large number of such articles have to be packed. Also, this fastening system gives rise to a further problem, namely that when a small number of articles are packed, they will not be properly held in place.

It is an object of this invention to provide an article of luggage with which this problem of a proper utilization of straps may be readily solved.

Accordingly, there is provided an article of luggage of the type comprising elastic straps intended for holding down articles of clothing and the like contained in said article of luggage, characterized in that each strap is attached to a fixed point at one of its ends and may be inserted into hooks located at various different levels.

Preferably, a choice should be available among three anchoring points for each end of a strap, these anchoring points being located on the peripheral wall of the article of luggage, at various levels from the bottom thereof.

The anchoring points may be in the form of independent hooks, but preferably they will be part of a single piece adapted for being positioned on the peripheral wall, perpendicularly to the bottom of the article of luggage.

The utilization of such pieces brings about a considerable reduction of the time required for the mounting of the article of luggage, since there will be generally four pieces to be installed, whereas if separate hooks are used, this would mean that twelve pieces would have to be arranged, in compliance with the spacings required between them.

These pieces will be obtained in a simple cost-saving manner through molding a plastic material of a polyolefin type having good mechanical characteristics.

Figure 2:
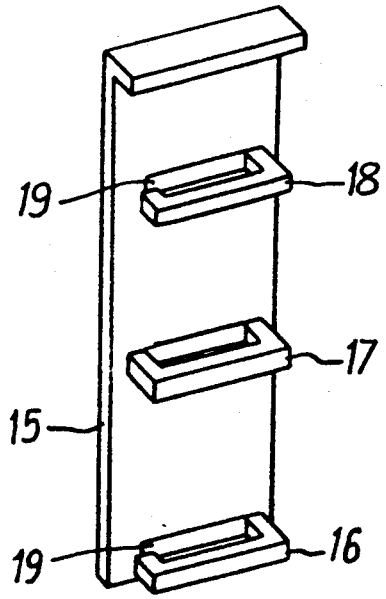
Figure 1:
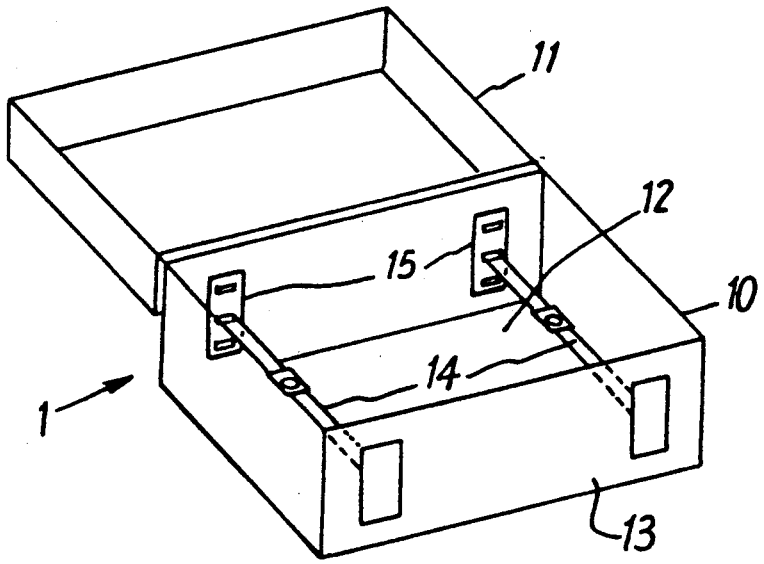
Figure 3:
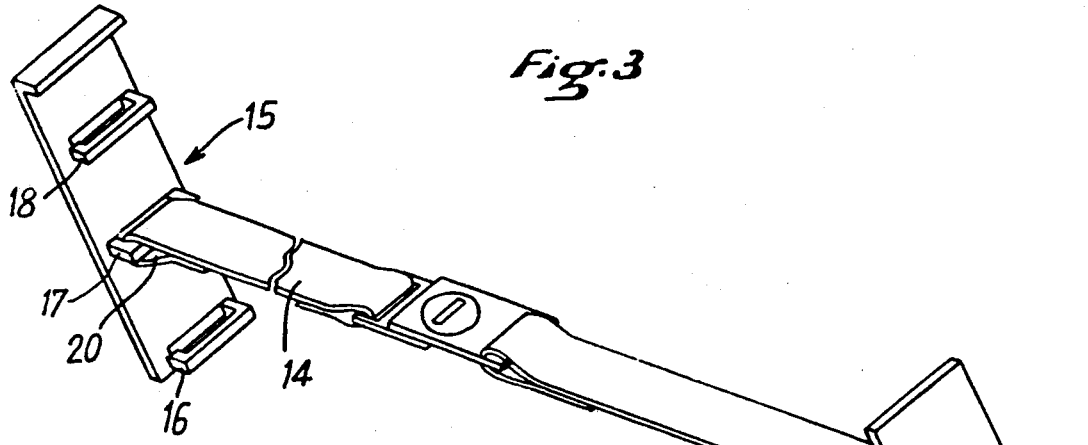
Figure 4:
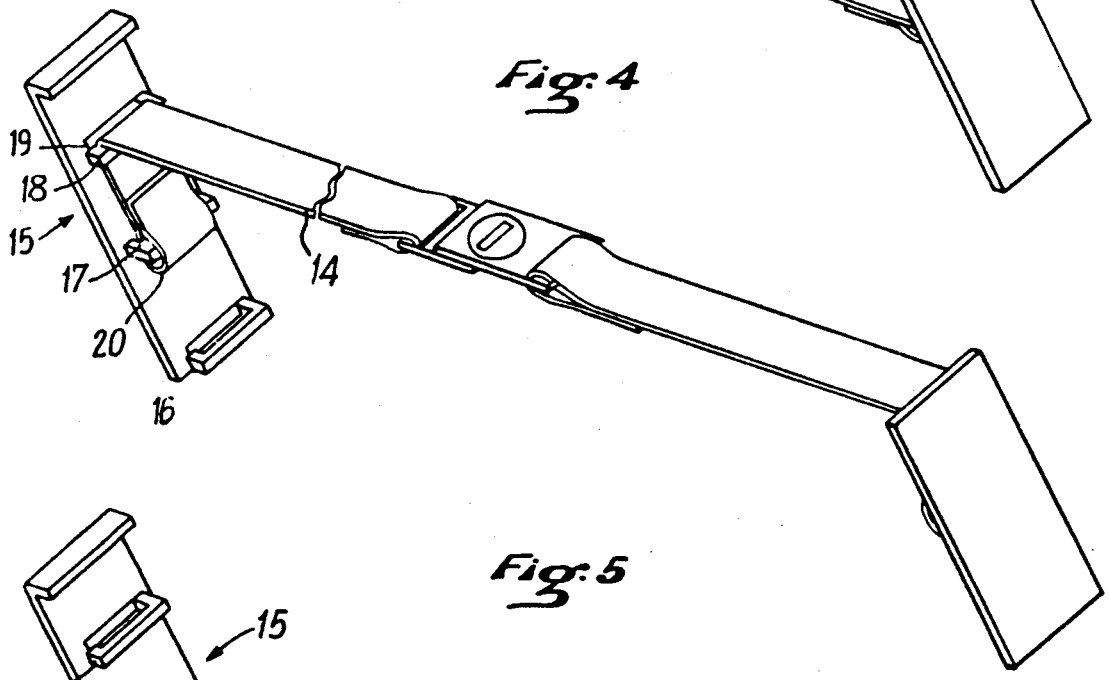
Figure 5:
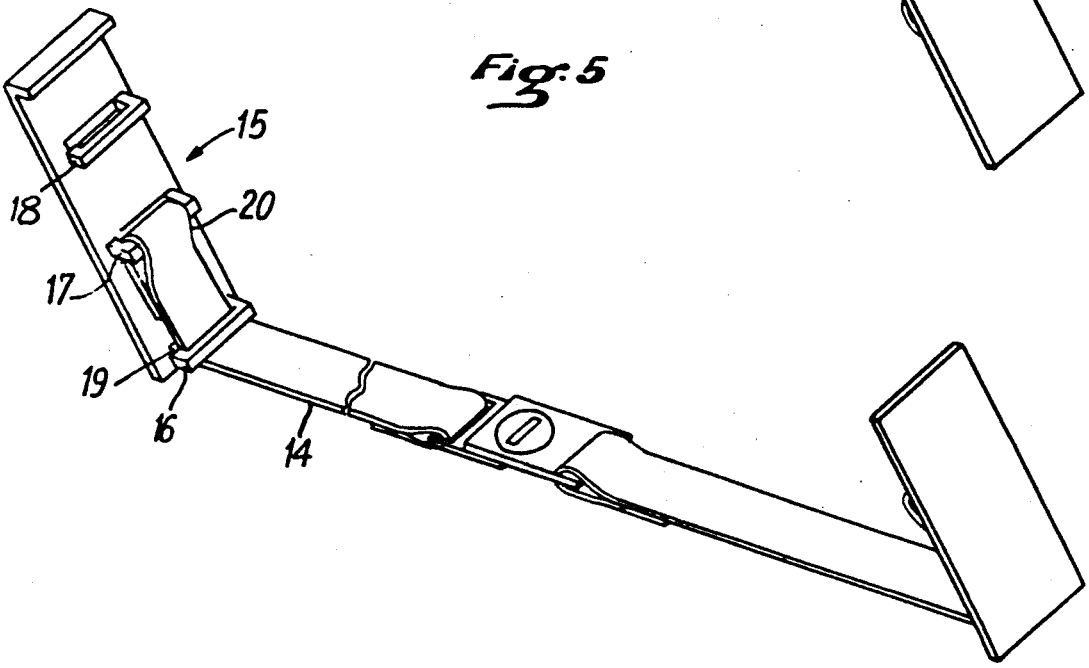

The present invention will be further described with reference to the appended drawings in which: FIG. 1 shows an article of luggage according to the invention; FIG. 2 shows a piece with which the invention may be put into practice; FIGS. 3 to 5 show various arrangements for the installation of a strap.

FIG. 1 shows an article of luggage 1 according to the invention. It is formed of a shell 10 and of a fold-down lid 11. The shell 10 is formed, in the usual manner, of a bottom 12 and a peripheral wall 13 to which are attached straps 14.

In a known manner, an elastic strap 14 extends between two parallel portions of the peripheral wall 13. This strap may be formed of two parts linked together by a fastening device, such as illustrated, or of a single piece.

According to the invention, the straps are attached to pieces 15 which comprise, as shown in FIG. 2, an anchoring point 17 and several hooks, such as the hooks 16 and 18.

Preferably, the fixation pieces 15 will be made of plastic mouldings.

In the example illustrated, the anchoring point 17 is located between the hooks 16 and 18 and consists of a closed U-shaped clamp, while the hooks 16 and 18 consist of C-clamps opened on one side with a gap 19. Each of the straps 14 is attached on its ends by a closed loop 20 on the closed clamp 17 of a piece 15 attached to the peripheral wall 13 of the shell 10, perpendicularly to the bottom 12 of this shell.

FIGS. 3 to 5 show the fastening of a strap 14 to the aforesaid fastening pieces 15, the representation of the luggage item 1 being omitted in these Figures for the sake of simplifying the drawing.

In FIGS. 1 and 3, it can be seen that when the strap 14 is being used such as it is fastened to said pieces 15, this strap extends parallel to the bottom 12, approximately at mid-height of the peripheral wall 13.

When numerous clothing articles have been placed inside the luggage item 1, the strap 14 is inserted into the side gap 19 of the hook 18, as shown in FIG. 4. Thus, this strap 14 will extend away from the peripheral wall at a point located substantially further away from the bottom 12, so that the clothes will not be creased. When, on the contrary, there are only few items to be placed in the luggage article, the strap 14 will be inserted into the gap 19 of hook 16, FIG. 5, and will then extend at a short distance from the bottom 12. The strap portion comprised between the anchoring clamp 17 and either of C-clamps 16 or 18 will be parallel to the peripheral wall and will not take part in the action of said strap.

It can then be understood that the distinctive feature of the article of luggage 1 according to the invention is that there is an available choice of several fastening points for the ends of each strap.

Obviously, each strap may be fastened at a level determined by the bulk of the articles being packed, and the various straps in one same piece of luggage will then be placed at different spacings from the bottom.

The invention further provides, for a purpose of simplifying the mounting operation of the pieces 15 carrying the hooks 16, 17, 18, and for saving time in this operation, that each piece 15 and its appended hooks will be manufactured as a single piece; however, the invention is not restricted to this feature, and the hooks 16, 17, 18 may also be designed as independent units, without departing from the scope of this invention.

The straps 14 may also be mounted otherwise than in the illustrated manner, in which they are perpendicular to the parallel portions of the peripheral wall. They may for instance be placed crosswise.

Also, they may be mounted in a V-shaped configuration, their ends being attached to the same portion of the peripheral wall.

I claim:

1. In a luggage article including a shell having a bottom wall and opposed side and end walls defining a cavity for containing clothing and the like, the improvement comprising:

a first elastic strap having opposed ends;

a first attachment bracket fixed to each opposed side wall a predetermined distance from said bottom wall, each end of said strap being fixed to a respective one of said attachment brackets; and a first adjustment bracket fixed to each opposed side wall in spaced, vertically aligned relation to the respective attachment bracket, each adjustment bracket having an opening for removably receiving a portion of said strap when elastically stretched from the respective end thereof fixed to the respective attachment bracket.

2. The luggage article of claim 1 wherein said elastic strap is divided into two parts at a position between the opposed ends thereof and includes a latch for selectively joining the two parts together.

3. The luggage article of claim 1 further including a second elastic strap having opposed ends, a second attachment bracket fixed to each opposed side wall in spaced, horizontally aligned relation to the respective first attachment bracket, each opposed end of the second strap being fixed to a respective second attachment bracket, and a second adjustment bracket fixed to each opposed side wall in spaced, vertically aligned relation to the respective second attachment bracket and spaced, horizontally aligned relation to the respective first adjustment bracket.

4. The luggage article of claim 3 including two second adjustment brackets fixed to each opposed side wall in spaced, vertically aligned relation to the respective second attachment brackets.

5. The luggage article of claim 1 including two first adjustment brackets fixed to each opposed side wall in spaced, vertically aligned relation to the respective first attachment brackets.

6. The luggage article of claim 1 wherein said elastic strap has an X shape and two pair of opposed ends, one opposed end of each pair being fixed to a respective first attachment bracket, and wherein the luggage article also includes a second attachment bracket fixed to each opposed side wall in spaced, horizontally aligned relation to the respective first attachment bracket, the other opposed end of each pair being fixed to a respective second attachment bracket, and a second adjustment bracket fixed to each opposed side wall in spaced, vertically aligned relation to the respective second attachment bracket and spaced, horizontally aligned relation to the respective first adjustment bracket.

7. The luggage article of claim 1 wherein each first attachment bracket and related first adjustment bracket are integrally formed on a respective mounting plate in said spaced, vertically aligned relation and each said mounting plate is fixed to a respective opposed side wall.

8. The luggage article of claim 1 wherein each first attachment bracket is U-shaped, the ends of the legs thereof being fixed to the respective side wall.

9. The luggage article of claim 1 wherein each first adjustment bracket is U-shaped, the end of one of the legs thereof being fixed to the respective side wall and said opening being defined by space between the end of the other leg and the respective side wall.

* * * * *